US010819028B1

(12) United States Patent
Rivera

(10) Patent No.: US 10,819,028 B1
(45) Date of Patent: Oct. 27, 2020

(54) TUNABLE PARALLEL PLATE ANTENNA

(71) Applicant: The United States of America as represented by the Secretary of the Navy, Newport, RI (US)

(72) Inventor: David F Rivera, Westerly, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/523,213

(22) Filed: Jul. 26, 2019

(51) Int. Cl.
*H01Q 9/00* (2006.01)
*H01Q 3/01* (2006.01)
*H01Q 9/04* (2006.01)
*H01Q 23/00* (2006.01)

(52) U.S. Cl.
CPC ..... *H01Q 3/01* (2013.01); *H01Q 9/0414* (2013.01); *H01Q 23/00* (2013.01)

(58) Field of Classification Search
None
See application file for complete search history.

(56) References Cited

U.S. PATENT DOCUMENTS 2,660,675 A * 11/1953 Amen ..... H01Q 9/14 343/815
2012/0112977 A1* 5/2012 Yun ..... H01Q 9/0414 343/772
2016/0020521 A1* 1/2016 Astakhov ..... H01Q 9/0428 343/769

* cited by examiner

*Primary Examiner* — Anh Q Tran
(74) *Attorney, Agent, or Firm* — James M. Kasischke; Michael P. Stanley

(57) ABSTRACT

A tunable antenna includes a base supporting a support and hollow tube opposing and spaced apart from one another, and spaced-apart and parallel plates. Each plate is coupled only at one end thereof to one of the support and hollow tube. One of the plates located furthest from the base extends past the hollow tube and is spaced apart therefrom. A shaft extends through the hollow tube and the one plate extending past the hollow tube. A tuning plate is coupled to the end of the shaft. A tuning piston is coupled to the shaft and is adapted for movement within the hollow tube where such movement changes the resonant frequency of the antenna.

20 Claims, 7 Drawing Sheets

TUNABLE PARALLEL PLATE ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates to tunable antennas, and more particularly to a parallel plate antenna that is tunable.

(2) Description of the Prior Art

U.S. Pat. No. 8,228,243 discloses a parallel plate antenna designed for use in a field-deployed shielded room. Specifically, the antenna is designed to determine a radio-frequency (RF) "leakiness" of a room. Such leakiness generally occurs at holes, ports, windows, etc., made in the walls or roof of the room. The disclosed antenna is placed in a room to be evaluated and measures RF energy associated with test pulses directed toward the room from a location outside the room.

The parallel plate antenna is compact and effective, but has a fixed resonant frequency thereby limiting the value of the antenna beyond specific applications.

SUMMARY OF THE INVENTION

Accordingly, it is an object of the present invention to provide a tunable antenna.

It is a further object of the present invention to provide a tunable parallel plate antenna.

In order to attain the objects of the present invention, a tunable antenna is provided which comprises a base and a support coupled to the base and extending perpendicular thereto. The antenna also comprises a hollow tube coupled to the base and extending perpendicular thereto. The support and hollow tube oppose one another and are spaced apart from one another.

The antenna also includes a plurality of plates spaced apart and parallel to one another. Each plate has a connected end and an unconnected end such that each plate is coupled only at the connected end to one of the supports and hollow tubes and extends out to the unconnected end thereof. One of the plates located furthest from the base extends past the hollow tube and is spaced apart therefrom.

A shaft has a first end coupled to the base, extends through the hollow tube and the one plate extending past the hollow tube such that the second end of the shaft is spaced apart from the one plate extending past the hollow tube. A tuning piston is coupled to the shaft and is adapted for movement along the shaft and within the hollow tube.

A tuning plate is coupled to the second end of the shaft. Each of the support, hollow tube, plates, shaft, tuning piston, and tuning plate are electrically conductive. The shaft, tuning piston, hollow tube, and tuning plate are also electrically coupled. The shaft is electrically isolated from the one plate extending past the hollow tube.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
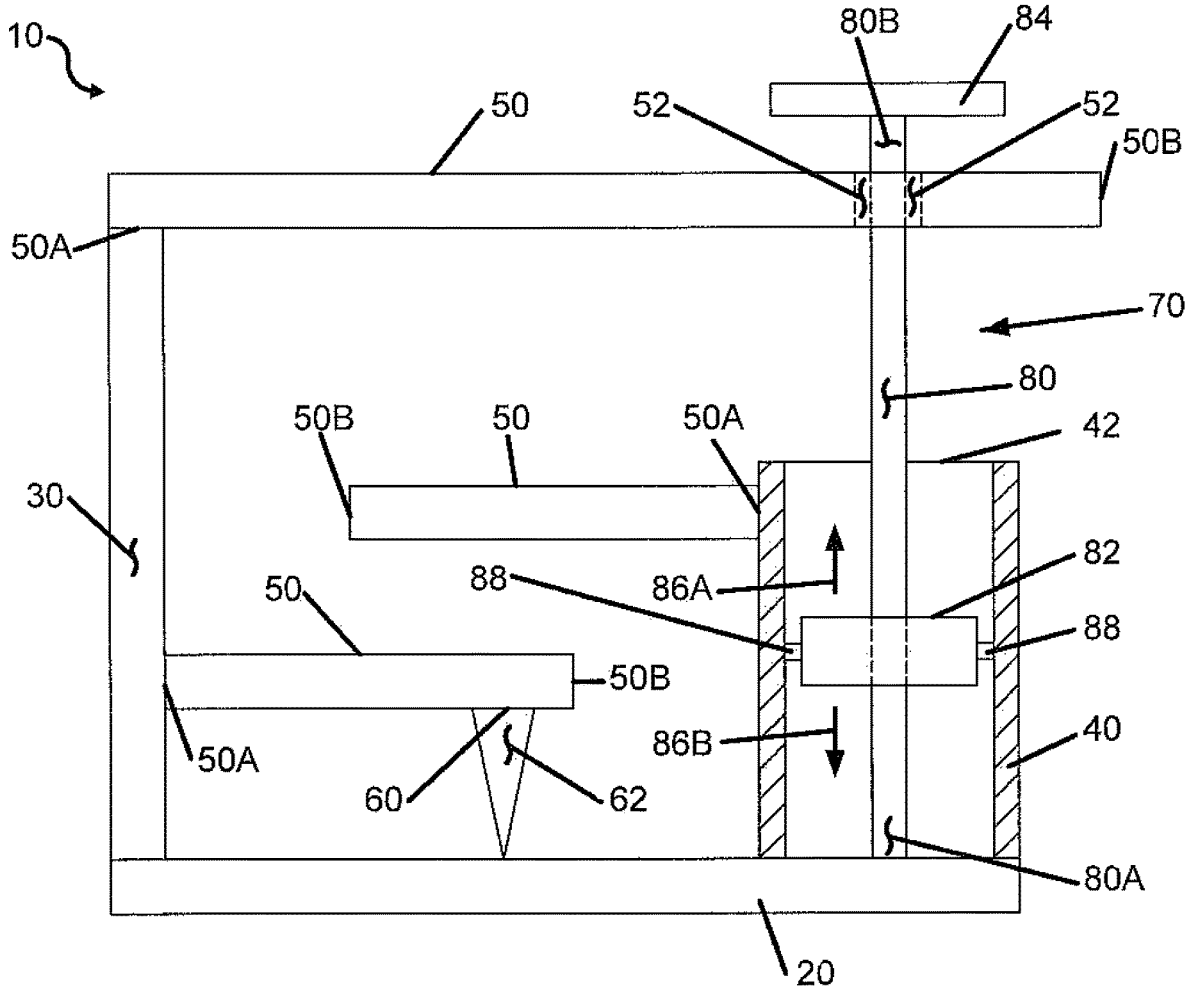
FIG. 1 is a cross-sectional and side view of a tunable parallel plate antenna in accordance with the present invention.

Referring now to the drawings and more particularly to FIG. 1, a parallel plate antenna in accordance with an embodiment of the present invention is shown and is referenced by numeral 10. In the illustrated embodiment, three parallel plates are shown. However, it is to be understood that an antenna in accordance with the present invention could be constructed with additional parallel plates without departing from the scope of the present invention.

Unless otherwise stated herein, the various parts of the antenna 10 need to be electrically conductive. Such electrical conductivity can be achieved by using solid metals for the various parts, metal-coated non-conductive substrates for the various parts, etc., without departing from the scope of the present invention.

The antenna 10 includes a base 20, a support 30 coupled to the base and extending perpendicularly therefrom. The antenna also includes a hollow tube 40 coupled to the base 20 and extending perpendicularly therefrom to an open end 42 and such that the support 30 and the hollow tube oppose one another in a spaced-apart fashion.

The antenna 10 also comprises a series of parallel plates 50 with each plate coupled to one of the supports 30 and with a hollow tube 40 extending perpendicularly away therefrom in a cantilevered fashion. That is, each plate 50 is connected on one end 50A thereof to the support 30 or the hollow tube 40 and is unconnected on another end 50B of the plate. Unless otherwise stated, the term "coupled" as used herein refers to mechanical and electrical coupling. It is to be understood that a variety of coupling or attachment schemes could be used without departing from the scope of the present invention.

The base 20 provides mechanical support for the support 30 and the hollow tube 40. Furthermore, the base 20 serves as an attachment point to an electrical ground plane (not shown) for the antenna 10. Each of the support 30 and the hollow tube 40 can have one or more plates 50 coupled thereto with the plates being alternately connected to the support or the hollow tube. The number of plates 50 shown in the figures is exemplary and is not to be considered as a limitation of the present invention. One of the plates 50 located closest to the base 20 defines a feed point 60 to which an antenna feed 62 is coupled. The antenna feed 62 can be conical (as shown), cylindrical, a plate, etc., without departing from the scope of the present invention.

The antenna 10 also includes a resonant frequency tuning mechanism that cooperates with the hollow tube 40 and one of the plates 50. More specifically, the plate 50 that is part of the tuning mechanism is located furthest from the base 20, and extends from the support 30 past the hollow tube 40 as the plate passes an open top 42 of the hollow tube in a spaced-apart fashion to define a gap region 70 defining the aperture of the antenna 10.

The tuning mechanism includes a shaft 80 supported on one end 80A thereof by the base 20 or another support mechanism (not shown) coupled to the base. A tuning piston 82 is coupled to the shaft 80 for movement within the hollow tube 40 while being electrically coupled to the hollow tube. A tuning plate 84 is coupled to the shaft 80 at an opposing end 80B.

The tuning mechanism operates to move the tuning piston 82 along the shaft 80 and in the hollow tube 40 as indicated by arrows 86A and 86B to tune the resonant frequency of the antenna 10 at the aperture 70. While a variety of tuning mechanism constructions can be used to generate and control movements in directions 86A and 86B, some non-limiting exemplary constructions will be described herein.

Figure 2:
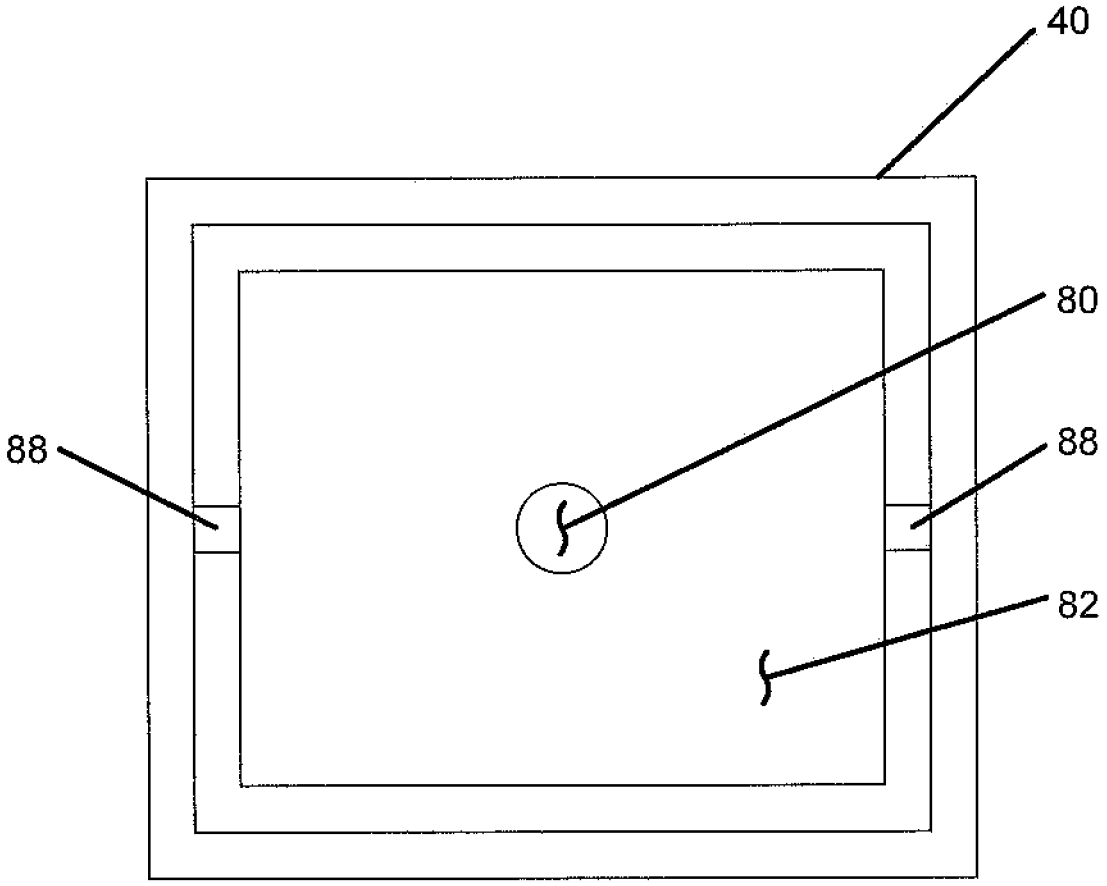
FIG. 2 is a plan view of the hollow tube and tuning piston taken along reference line 2-2 of FIG. 1 and in accordance with the present invention.

Referring now to FIG. 2, the hollow tube 40 can be rectangular with the tuning piston 82 being similarly shaped for movement within the tube. It is to be understood that the radial cross-sectional shapes of the hollow tube 40 and the tuning piston 82 could also be circular, triangular, or in the shape of other polygons without departing from the scope of the present invention. The tuning piston 82 can be electrically coupled to the hollow tube 40 by electrical contacts 88 such as leaf springs, brushes, etc. Such electrical conductivity between the hollow tube 40 and the tuning piston 82 can also be provided by mechanical linkage mechanisms as will be described below.

Figure 3:
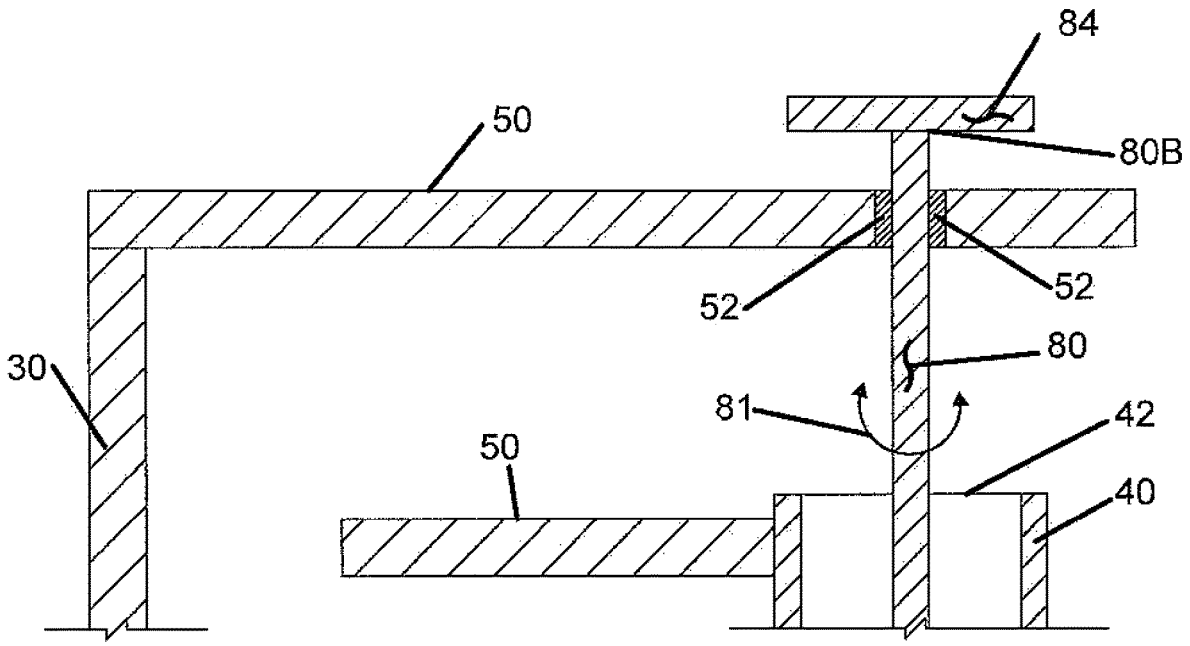
FIG. 3 is a cross-sectional view of the top plate, shaft, and tuning plate of the antenna in accordance with the present invention.

Referring additionally now to FIG. 3, the shaft 80 extends through the one plate 50 that extends over the open end 42 of the hollow tube 40. The shaft 80 is electrically isolated from the plate 50 using a dielectric bushing 52 disposed between the shaft and the plate where the shaft passes through the plate. End 80B of the shaft 80 is mechanically and electrically coupled to the tuning plate 84.

By way of example, if the shaft 80 is a rotating shaft as indicated by a rotational arrow 81, the tuning plate 84 can be coupled to the shaft for rotation in correspondence therewith. In such a case, the tuning plate 84 also functions as a flywheel to maintain smooth rotational movement of the shaft 80 which, in turn, translates to smooth the movements 86A and 86B of the tuning piston 82.

Figure 4:
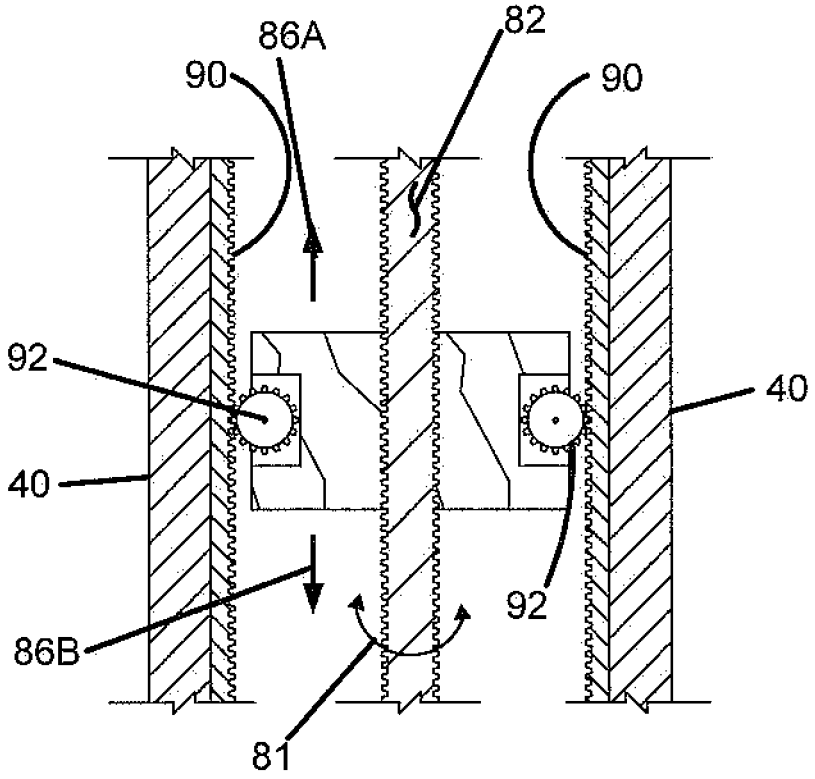
FIG. 4 is a cross-sectional view of the hollow tube and tuning piston illustrating gears used to translate rotation of the shaft to linear movement of the tuning piston in accordance with the present invention.

As mentioned above, a variety of constructions can be used to bring about the movements 86A and 86B of the tuning piston 82. With reference to FIG. 4, the shaft 80 and the tuning piston 82 can be in threaded engagement with one another. Mechanical and electrical coupling between the hollow tube 40 and the tuning piston 82 are provided by gears. In the illustrated embodiment, rack gears 90 are coupled to opposing side walls of the hollow tube 40. Cooperating pinion gears 92 are disposed in opposing lateral edges of the tuning piston 82. By virtue of this construction, when the shaft 80 experiences the rotational movement 81, the tuning piston 82 experiences movement 86A or 86B depending on the direction of the rotational movement as the pinion gears 92 engage the rack gears 90.

The shapes of the plates 50 can all be rectangular as shown and described in the afore-mentioned U.S. Pat. No. 8,228,243. However, the present invention is not so limited. For example, the plates 50 between the base 20 and the one plate extending over the hollow tube 40 can be T-shaped as described in U.S. patent application Ser. No. 16/143,593, filed Sep. 27, 2018, the contents of which are incorporated herein by reference.

The ability to change the antenna's resonant frequency is now explained. The internal dimensions of the hollow tube 40, the shaft 80, and the tuning piston 82 are very small as compared to the operating wavelengths of the antenna 10 such that the tuning mechanism behaves as a lumped-element circuit.

To understand the behavior of the tuning mechanism behavior, one can temporarily ignore the elements of the tuning mechanism that are internal to the hollow tube 40. In this state, a complex admittance of value $Y_1$ ($Y_1=G_1+jB_1$) appears across the aperture 70.

The real part of the admittance (i.e., $G_1$), called the conductance, is a function of antenna geometry and frequency and describes the conversion of stored energy in the parallel plate region into radiation across the aperture 70 and into the surrounding space. The imaginary part of the admittance (i.e., $B_1$), also a function of geometry and frequency is called the susceptance. The susceptance describes the energy storage across the aperture 70. The admittance therefore describes, in total, the imperfect "leakiness" of energy from the parallel plate cavity and into space and is responsible for generating current flow on the external surface of the antenna 10 to thereby form the radiated field.

Adding back the elements of the tuning mechanism that are internal to the hollow tube 40 adds another admittance $Y_2$ ($Y_2=G_2+jB_2$) in parallel with the admittance $Y_1$ to thereby yield a total admittance $Y_t$ across the aperture 70 that is the sum of admittances $Y_1$ and $Y_2$. The movement 86A or 86B of the tuning piston 82 changes the value of $Y_2$, which when combined with $Y_1$, causes a shift in resonant frequency of the antenna 10. The admittance $Y_2$ of the tuning mechanism is formed by the electrostatic coupling to the uppermost plate 50 by means of the tuning plate 84.

The parallel plate region of the antenna 10 is a conveyor of radio-frequency power. In a transmission mode, the feed point 60 is energized with an alternating voltage and a propagating electromagnetic field is established in the region that is "leaked" across the aperture 70 (with an admittance $Y_t$) to generate an external surface distribution of current that, in turn, generates a radiated field. The same action occurs in reception, but in reverse order. When the spacing of the parallel plates 50 is small compared to the operating wavelength; power transfer to and from the aperture 70 is efficient because the fields in the parallel plate region are highly confined.

Figure 5:
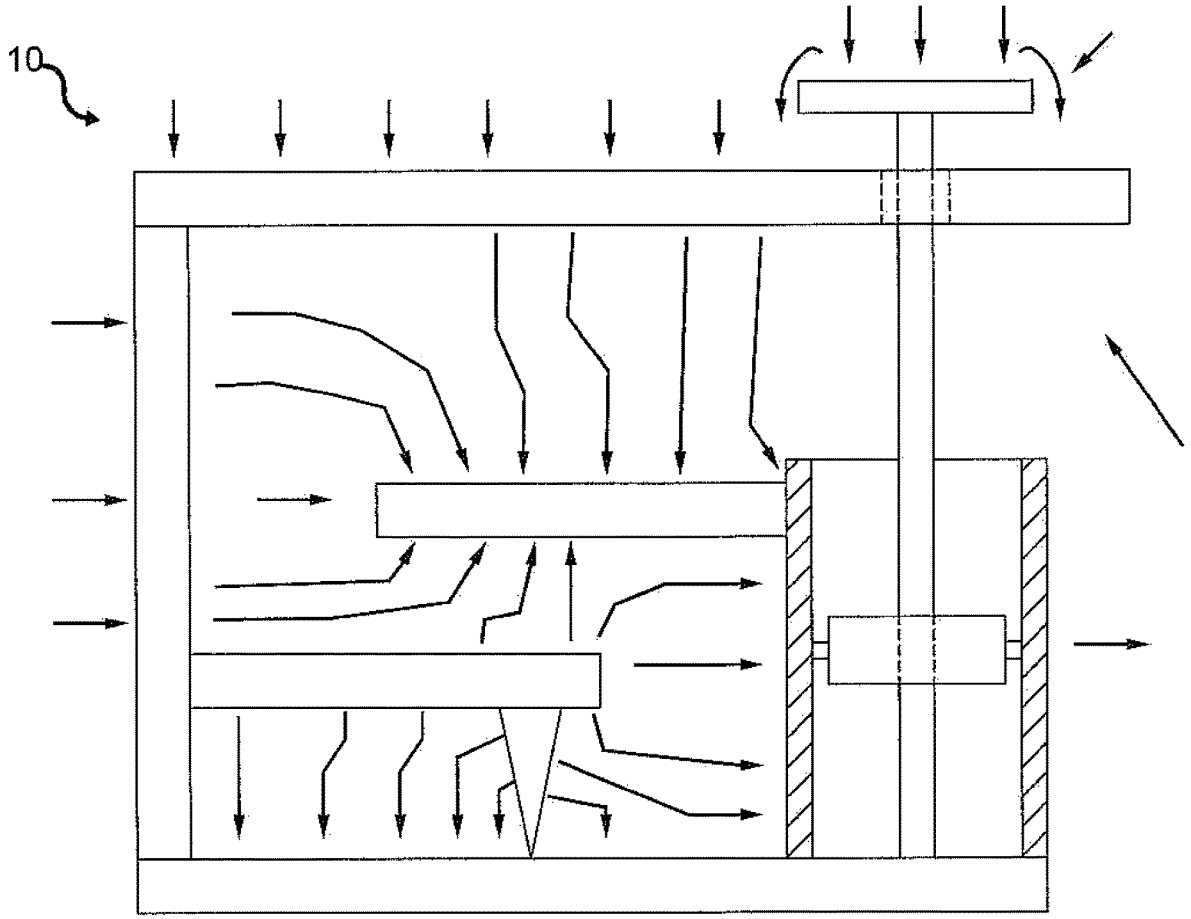
FIG. 5 is a side view of the tunable parallel plate antenna illustrating an electric field distribution of the antenna.
Figure 6:
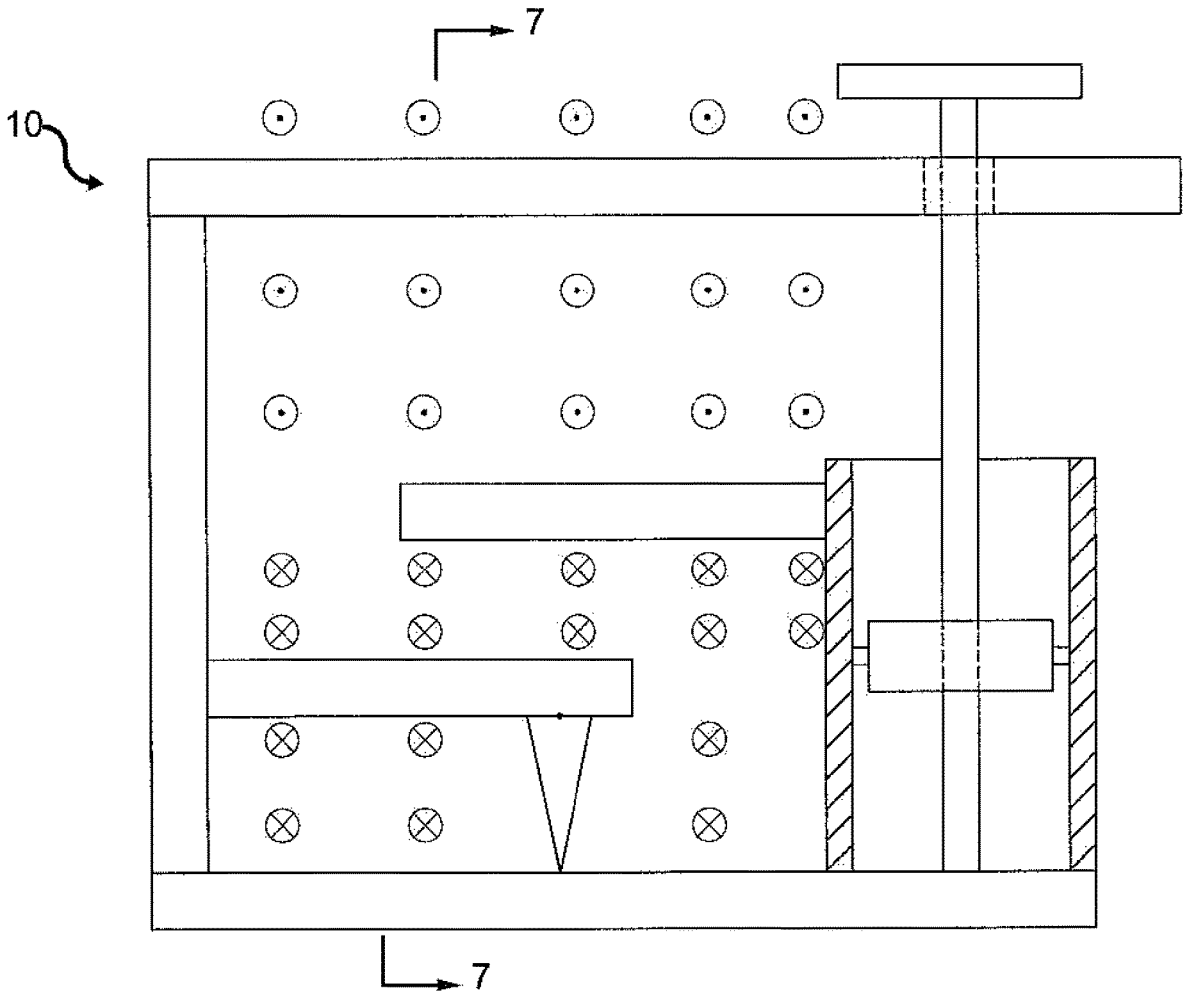
FIG. 6 is a side view of the tunable parallel plate antenna illustrating a magnetic field distribution of the antenna.
Figure 7:
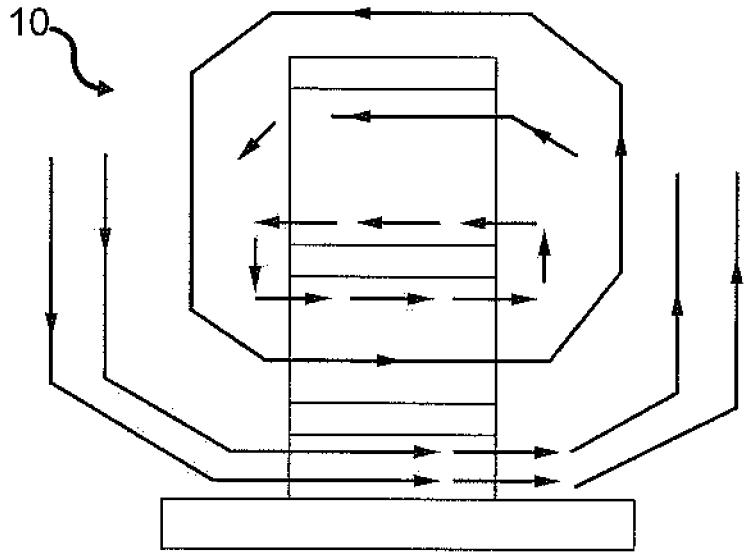
FIG. 7 is a cross-sectional view taken along reference line 7-7 in FIG. 6 illustrating the magnetic field distribution of the antenna.

Referring now to FIGS. 5-7, the internal electric (FIG. 5) and magnetic field (FIG. 6 and FIG. 7) distributions are illustrated for the antenna 10. The illustrations are "snapshots" in an instant of time because the fields alternate rapidly in polarity when traveling towards the aperture 70 at nearly the speed of light. The electric and magnetic fields actually exist simultaneously, but are shown separately to avoid confusion.

The advantages of the present invention are numerous. The antenna 10 can be readily tuned to any resonant frequency in a design range of the antenna. Movement of the tuning piston 82 can be affected through a variety of manual, automated, and even remotely-controlled mechanisms.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A tunable antenna comprising:

a base;

a support coupled to said base and extending perpendicular to said base;

a hollow tube coupled to said base and extending perpendicular to said base, wherein said support and said hollow tube oppose one another and are spaced apart from one another;

a plurality of plates spaced apart and parallel to one another, each of said plates having a connected end and an unconnected end, each of said plates coupled only at the connected end thereof to one of said support and said hollow tube and extending out to the unconnected end thereof;

one of said plates located furthest from said base extending past said hollow tube and spaced apart therefrom;

a shaft having a first end and a second end, said first end coupled to said base, said shaft extending through said hollow tube and said one of said plates wherein said second end of said shaft is spaced apart from said one of said plates;

a tuning piston coupled to said shaft and adapted for movement therealong within said hollow tube;

a tuning plate coupled to said second end of said shaft;

each of said support, said hollow tube, said plates, said shaft, said tuning piston, and said tuning plate being electrically conductive;

said shaft, said tuning piston, said hollow tube, and said tuning plate being electrically coupled; and said shaft being electrically isolated from said one of said plates.

2. A tunable antenna as in claim 1, wherein said plates are alternately connected to said support and said hollow tube.

3. A tunable antenna as in claim 1, wherein each of said plates extends perpendicular to said one of said support and said hollow tube.

4. A tunable antenna as in claim 1, further comprising an antenna feed electrically coupled to another of said plates.

5. A tunable antenna as in claim 1, wherein said shaft is adapted to be rotated.

6. A tunable antenna as in claim 1, wherein said shaft and said tuning plate are adapted to be rotated in unison.

7. A tunable antenna as in claim 1, wherein said shaft and said tuning piston are in threaded engagement, said tunable antenna further comprising gears for mechanically and electrically coupling said tuning piston to said hollow tube wherein rotation of said shaft causes said movement of said tuning piston within said hollow tube.

8. A tunable antenna as in claim 1, wherein said hollow tube has an open end spaced apart from said one of said plates.

9. A tunable antenna comprising:

a base;

a support coupled to said base and extending perpendicular to said base;

a hollow tube coupled to said base and extending perpendicular to said base, wherein said support and said hollow tube oppose one another and are spaced apart from one another;

a plurality of plates spaced apart and parallel to one another, each of said plates having a connected end and an unconnected end, each of said plates coupled only at the connected end thereof to one of said support and said hollow tube and extending out to the unconnected end thereof, said plates being alternately connected to said support and said hollow tube;

one of said plates located furthest from said base extending past said hollow tube and spaced apart therefrom;

an antenna feed electrically coupled to another of said plates located closest to said base;

a shaft having a first end and a second end, said first end coupled to said base, said shaft extending through said hollow tube and said one of said plates wherein said second end of said shaft is spaced apart from said one of said plates;

a tuning piston coupled to said shaft and adapted for movement therealong within said hollow tube;

a tuning plate coupled to said second end of said shaft wherein said tuning plate is spaced apart from said one of said plates;

each of said support, said hollow tube, said plates, said shaft, said tuning piston, and said tuning plate being electrically conductive;

said shaft, said tuning piston, said hollow tube, and said tuning plate being electrically coupled; and said shaft being electrically isolated from said one of said plates.

10. A tunable antenna as in claim 9, wherein each of said plates extends perpendicular to said one of said support and said hollow tube.

11. A tunable antenna as in claim 9, wherein said shaft is adapted to be rotated.

12. A tunable antenna as in claim 9, wherein said shaft and said tuning plate are adapted to be rotated in unison.

13. A tunable antenna as in claim 9, wherein said shaft and said tuning piston are in threaded engagement, said tunable antenna further comprising gears for mechanically and electrically coupling said tuning piston to said hollow tube wherein rotation of said shaft causes said movement of said tuning piston within said hollow tube.

14. A tunable antenna as in claim 9, wherein said hollow tube has an open end spaced apart from said one of said plates.

15. A tunable antenna comprising:

a base;

a support coupled to said base and extending perpendicular to said base;

a hollow tube coupled to and extending perpendicular to said base, said hollow tube terminating in an open end, said support and said hollow tube opposing one another and spaced apart from one another;

a plurality of plates spaced apart and parallel to one another, each of said plates having a connected end and an unconnected end, each of said plates coupled only at said connected end thereof to one of said support and said hollow tube and extending out to said unconnected end thereof;

one of said plates located furthest from said base extending past said open end of said hollow tube and spaced apart therefrom;

a shaft having a first end and a second end, said first end coupled to said base, said shaft extending through said hollow tube and said one of said plates wherein said second end of said shaft is spaced apart from said one of said plates;

a tuning piston threadably coupled to said shaft and mechanically coupled to said hollow tube, wherein rotation of said shaft causes movement of said piston along said shaft and within said hollow tube;

a tuning plate coupled to said second end of said shaft, said tuning plate being spaced apart from said one of said plates;

each of said support, said hollow tube, said plates, said shaft, said tuning piston, and said tuning plate being electrically conductive;

said shaft, said tuning piston, said hollow tube, and said tuning plate being electrically coupled; and said shaft being electrically isolated from said one of said plates.

16. A tunable antenna as in claim 15, wherein said plates are alternately connected to said support and said hollow tube.

17. A tunable antenna as in claim 15, wherein each of said plates extends perpendicular to said one of said support and said hollow tube.

18. A tunable antenna as in claim 1, further comprising an antenna feed electrically coupled to another of said plates located closest to said base.

19. A tunable antenna as in claim 15, wherein said shaft is coupled to said tuning plate for rotation in unison.

20. A tunable antenna as in claim 15, further comprising gears for mechanically and electrically coupling said tuning piston to said hollow tube wherein rotation of said shaft causes said movement of said tuning piston within said hollow tube.

* * * * *